US008905723B1

(12) United States Patent
Blanco

(10) Patent No.: US 8,905,723 B1
(45) Date of Patent: Dec. 9, 2014

(54) VENTURI

(71) Applicant: Pedro P Blanco, Cutler Bay, FL (US)

(72) Inventor: Pedro P Blanco, Cutler Bay, FL (US)

( * ) Notice: Subject to any disclaimer, the term of this patent is extended or adjusted under 35 U.S.C. 154(b) by 0 days.

(21) Appl. No.: 14/296,378

(22) Filed: Jun. 4, 2014

(51) Int. Cl.
*B63H 11/103* (2006.01)
*F04F 5/44* (2006.01)
*F04F 5/46* (2006.01)

(52) U.S. Cl.
CPC ..... *B63H 11/103* (2013.01); *F04F 5/461* (2013.01)
USPC ..... 417/187; 417/198; 440/47; 137/892; 138/45

(58) Field of Classification Search
CPC ..... B63H 11/103; F04F 5/461
USPC ..... 417/181, 182, 193, 187, 198; 440/38, 440/47; 137/892; 138/45
See application file for complete search history.

(56) References Cited

U.S. PATENT DOCUMENTS

| | | | | | |
|---|---|---|---|---|---|
| 178,434 | A * | 6/1876 | Guthrie | 417/187 |
| 919,266 | A * | 4/1909 | Tomlinson | 417/76 |
| 2,258,961 | A * | 10/1941 | Saathoff | 417/84 |
| 2,934,892 | A * | 5/1960 | Hurlbert et al. | 239/265.39 |
| 3,214,903 | A * | 11/1965 | Cochran | 60/221 |
| 3,266,242 | A * | 8/1966 | Aschauer | 60/221 |
| 3,531,218 | A * | 9/1970 | Warner | 417/183 |
| 3,552,883 | A * | 1/1971 | Weatherbee | 417/76 |
| 3,906,885 | A * | 9/1975 | Woodfill | 440/42 |
| 4,092,010 | A | 5/1978 | Carlson | |
| 4,595,344 | A * | 6/1986 | Briley | 417/185 |
| 5,256,090 | A * | 10/1993 | Woolley | 440/40 |
| 5,542,863 | A * | 8/1996 | Brian et al. | 440/47 |
| 5,700,170 | A * | 12/1997 | Mataya | 440/47 |
| 5,863,229 | A * | 1/1999 | Matte | 440/47 |
| 5,879,209 | A * | 3/1999 | Jones | 440/42 |
| 6,293,836 | B1 | 9/2001 | Blanchard | |
| 6,857,920 | B2 * | 2/2005 | Marathe et al. | 440/38 |
| 7,789,633 | B2 * | 9/2010 | Tash | 417/198 |
| 7,958,838 | B1 | 6/2011 | Larose | |
| 8,491,347 | B2 | 7/2013 | Fischer | |
| 2004/0121663 | A1 | 6/2004 | Marathe et al. | |
| 2011/0207375 | A1 | 8/2011 | Fischer | |

FOREIGN PATENT DOCUMENTS

| | | |
|---|---|---|
| CA | 2207469 | 12/1997 |

* cited by examiner

*Primary Examiner* — Charles Freay
(74) *Attorney, Agent, or Firm* — Christopher J. Vandam, P.A.; Chris Vandam

(57) ABSTRACT

A marine jet pump with an adjustable venturi. An annularly compressible ring is affixed coaxially to the aft end of the pump housing. A collar coaxial to the ring is moveable coaxial to the ring. In a constricted mode the collar is mechanically forced over the aft end of the ring thereby reducing the diameter of the ring. In a dilated mode the collar is mechanically withdrawn to a predetermined degree from over the aft end of the ring allowing the ring to revert to it naturally dilated state. The transition between dilated mode and constricted mode can occur under full power.

5 Claims, 4 Drawing Sheets

VENTURI

BACKGROUND OF THE INVENTION

1. Field of the Invention

The present invention relates to marine vehicles, and more particularly, to jet pump driven watercraft propulsion systems.

2. Description of the Related Art

Several designs for marine craft jet propulsion adjustable venturi systems have been designed in the past. None of them, however, includes a low cost and robust system with minimal moving parts in critical areas resulting in an adjustable diameter venturi that is able to handle greater power throughput and yet reduces the likelihood of catastrophic failure during high performance use.

It has been long known that pairing a jet pump with a venturi of certain diameters can affect the pressure of water passing through the pump in relation to the speed in which that water passes through the pump housing, ultimately exiting through a venturi.

The common solution is to match a pump with a venturi to achieve a resulting performance metric. Invariably this requires a compromise between volume of flow, velocity of flow and pressure. It has been difficult, if not impossible to gain performance at both opposing ends of the hydrodynamic performance spectrum.

There have been several attempts to vary the diameter of a jet drive venturi using several theories. Broadly, these attempts can be categorized as bladder style, trap door style or iris style.

The bladder style inflates elastic bladders inside the venturi to affect the net diameter of the output tube. A pump and valve system is provided to inflate and deflate the bladders. The bladders have a tendency to wear out and can be expensive to repair or replace. There are inherent dangers of a high pressure hydraulic system that are also avoided in the present system. There is also a risk of environmental contamination with any hydraulic failure that can occur either inside the hull or outside the hull in the waterways.

The trap door style of adjustment means mechanically articulates a panel that adjustably covers a portion of the exit pathway. These are prone to mechanical breakage due to the brute force required to restrict the ejected water. These systems also have a tendency to redirect the direction of the flow of water exiting the pump which can have a detrimental effect on performance.

The iris style of solution to the adjustable venturi problem utilizes a plurality of overlapping leaves that articulate to form an aperture about an imaginary center. This method is similar to that traditionally used in cameras. It requires many fragile moving parts. Although it appears to be an elegant solution, demanding use in the harsh marine environment with ever increasing horsepower of connected power plants, has proved this design not workable.

Applicant believes what appears to be the closest reference corresponds to U.S. Pat. No. 5,863,229 issued to Matte. However, it differs from the present invention because the present invention evenly compresses about the centerline of thrust. Looking at Matte in FIGS. 10 and 11, at first the means to restrict the diameter of the venturi may appear similar. Matte uses a ring that moves over the venturi and a series of arrows representing flow lines to make it appear as if the diameter is changing between the modes in FIGS. 10 and 11. In fact, these figures do not show any diameter change. The diameter remains fixed at the narrower, inner diameter of the venturi.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a venturi having a variable diameter.

It is another object of this invention to provide a venturi that can be adjusted larger or smaller from the captain or driver position.

It is still another object of the present invention to provide a venturi that can be adjusted at any setting between wide open throttle and idle throttle and even while the engine is off.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
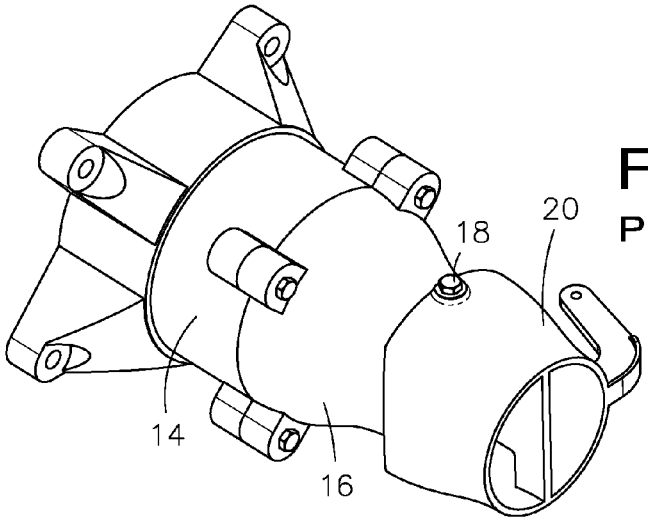
Fig. 1 PRIOR ART
FIG. 1 represents a perspective view of an example of a prior art pump and venturi combination with a nozzle.

Jet powered watercraft are contrasted to other types of craft in that there is no exposed propeller that turns in the water. Most jet powered boats have a motor that turns in impeller inside of a housing. Water is sucked into the housing forward of the impeller through an intake. The impeller spins and pushes water through the housing then through a venturi. In some watercraft there is a steering nozzle aft of the venturi that directs the flow of the water.

There are other variations of the jet powered watercraft that more or less include the above identified parts and work in a mechanically similar way. Common versions include inboard boats such as some ski boats and personal watercraft and outboard motors that replace a traditional lower unit with a jet pump assembly. Any variety of jet pump watercraft can be adapted to effectively work to enhance performance characteristics with the present invention in its several variations.

Isaac Newton's third law of classical mechanics can be summarized as: When one body exerts a force on a second body, the second body simultaneously exerts a force equal in magnitude and opposite in direction to that of the first body.

This basic law is directly applied to hydraulic jet pumps, such as used in personal watercraft and other marine craft commonly referred to as jet-style boats. A jet pump sucks in water and propels it behind the water craft for forward propulsion.

Restating Newton's third law and applying it to jet watercraft: The force of water exiting the rear of the watercraft propels the watercraft forward with equal force. Every action has an equal and opposite reaction. Water pushed back results in watercraft being pushed forward, thus motion is achieved.

$$F=ma$$

Force equals mass multiplied by acceleration. Force remains constant for a constant motor and pump. As the mass of water exiting the pump increases the acceleration of water must therefore decrease. As the mass of water flowing through a pump decreases the acceleration increases for a constantly applied force.

This over simplifies more complex interactions but the point is still evident. It can easily be seen that a garden hose with an unrestricted end will squirt water some distance. As a thumb is placed over the end of the hose to restrict the mass of water squirted the stream of water is propelled further.

A jet propelled watercraft cannot move faster than the velocity of the water ejected out of the pump. Within limitations, faster moving water through the pump has the potential to push the watercraft faster. Obviously, there is a point of diminishing return on the speed of the watercraft if the volume of water is low even with a great velocity of the water.

There is, however, a sweet spot (or range) of volume of water versus velocity of water ejected for a given combination of watercraft to produce maximum power at one end of the range and maximum resulting speed at the other end of the range.

The jet drive venturi now provides an effective means for varying the velocity and pressure of water ejected at a given power input while the watercraft is underway. Generally, this is achieved by varying the diameter of the venturi while the pump is in operation.

It should be noted that throughout this written description, which is intended to be read in combination with the drawings, the jet drive venturi is sometimes interchangeably referred to as the invention, device or other similar terms. The masculine may represent the feminine or neuter and singular the plural or vice-versa as may be appropriate by context and a general understanding of other teachings in the art and surrounding classes of art.

Figure 2:
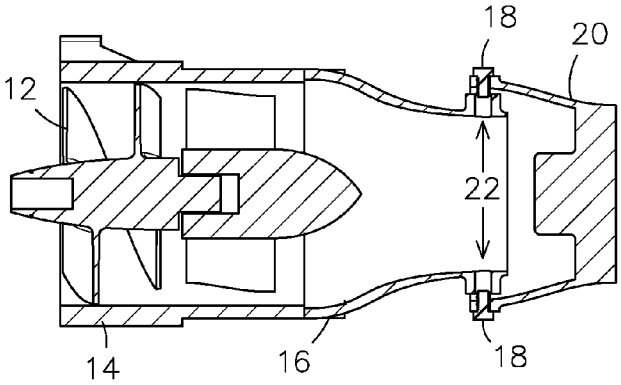
Fig. 2 PRIOR ART
FIG. 2 shows an elevation cross section view of a combination similar to that in FIG. 1.

Referring now to the drawings, where a typical example of a prior art jet pump is generally shown in FIGS. 1 and 2. It can be observed that it basically includes an impeller 12, a housing 14, a venturi 16, a hinge 18, a nozzle 20 and a diameter 22.

An impeller 12 is positioned in the forward side of the housing. A shaft, not shown in FIGS. 1 and 2 is connects the impeller 12 to a motor forward of the impeller 12. The impeller 12 and motor combination draws water in and propels the water through the venturi 16. The water exits at high volume and low pressure through the nozzle 20.

The nozzle 20 directs the exiting flow of water to provide a means to steer the watercraft to which the jet pump is attached. The nozzle 20 articulates left and right about hinges 18. Typically, the driver of the watercraft uses a steering wheel or handlebars to mechanically force the nozzle 20 side to side. The resulting directed stream of water exiting the nozzle 20 tends to steer the watercraft to the left or right when the engine is under power.

In the past, a rigid metal venturi 16 with a fixed diameter 22 is bolted to the pump housing 14. Obviously then, during on the water operation of the water vehicle that combination is fixed. To change the diameter 22 the water vehicle must be removed from the water, the venturi 16 is unbolted and removed from the housing 14. A different venturi with a different diameter could then bolted in its place. The craft is then returned to the water for continued use.

The diameter 22 is an important dimension that is carefully calibrated to match the performance requirements of the combination of watercraft, passengers, engine power, impeller and other factors affecting operation of the vehicle. Small variations in the diameter 22 can have profound effects on performance. The diameter 22 has a direct correlation to the pressure of the pump.

Generally, for a given combination of watercraft, engine and impeller, a larger diameter 22 of the venturi 16 will decrease the pressure of water and allow it to pass through the pump at a slower velocity than a smaller diameter. Conversely, a smaller diameter 22 of the venturi 16 will increase the pressure of water and allow it to pass through the pump at a higher velocity than a larger diameter.

The resulting effect on performance is acceleration from low speed and top end speed. During acceleration (from low speed) the venturi in its widest position has less pressure, offering the engine a lower load. This results in a faster acceleration of the engine. A thicker and heavier stream of water creates a higher action-reaction effect. These two factors, among others, increase the acceleration of the craft.

At top speed the venturi is in its narrower position and has a higher pressure. This results in higher top speed. It also gives the engine a higher load. If this extra load is given to the engine at high RPM (revolutions per minute) it is also closer or at the top of its horse power and torque. This is the best moment to handle the extra load of pressure.

Practically, for a given watercraft, a larger venturi will provide the craft improved acceleration or hole shot. This is contrasted to a smaller venturi which can eject water at higher speeds out of the pump can result in higher top end speeds.

Until now, a rider had to select a venturi diameter before going onto the water. With the present jet drive venturi the rider can now effectively shift from low speed power for acceleration to high speed when the power for acceleration is no longer needed. It can be fairly said that the jet drive venturi is analogous to a transmission on a car because the engine's power can now be better converted from efficient use at low speeds where acceleration is needed to higher speeds when the acceleration is no longer needed and speed is preferred.

Looking now to FIGS. 3 through 8 where a version of the device is shown from several view and in alternate modes, it can be seen that it generally includes, among other elements, a housing 24, an impeller 26, a hinge 28, a bracket 30, a ring 32, a bracket 34, a collar 36, a hinge 38, a hinge 40, a nozzle 42, a bracket 44, an arm 46, a lever 48, a hinge 50, a cable 52, a bracket 54, an adjuster 56, a sheath 58, a fastener 60, a spring 61, a band 62, a zone 66 and a diameter 68.

Some of components of the prior art device remain in the present jet drive venturi device. The housing 24, impeller 26 and nozzle 42 perform similar functions to similar appearing elements of the prior art design as shown and discussed above.

An important feature of the jet drive venturi is the combination of the ring 32 and collar 36. Generally, the ring 32 is attached to the housing 24 so that a flow of water through the housing 24 passes completely through the ring 32 and then through the collar 36 before the flow of water passes through the nozzle 42.

The ring 32 is constructed having a specific interior diameter (ID) and outside diameter (OD) at the rear or exit end of the ring. The forward edge of the ring 32 is dimensioned to connect to the rear end of the housing 24. The forward edge of the ring 32 has a substantially watertight seal with the rear end of the housing 24.

Figure 3:
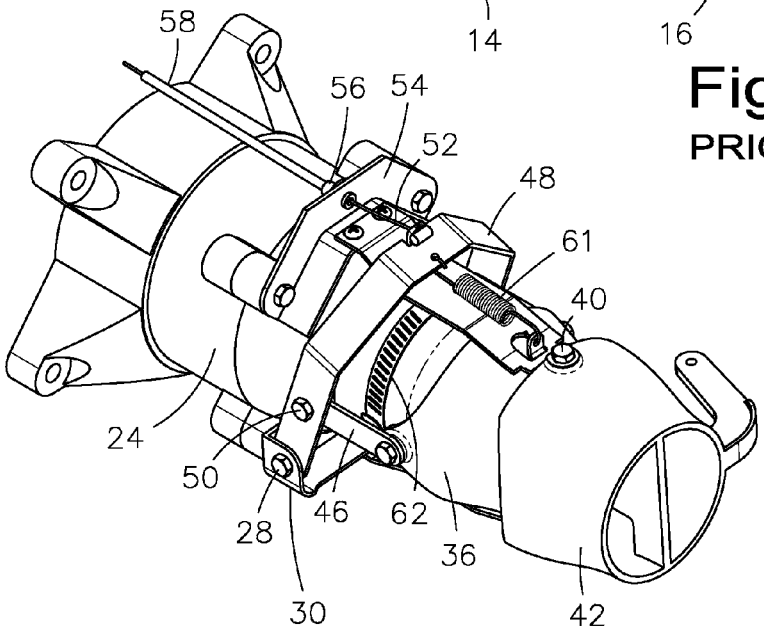
FIG. 3 illustrates a perspective view of a version of a variable jet venturi.
Figure 8:
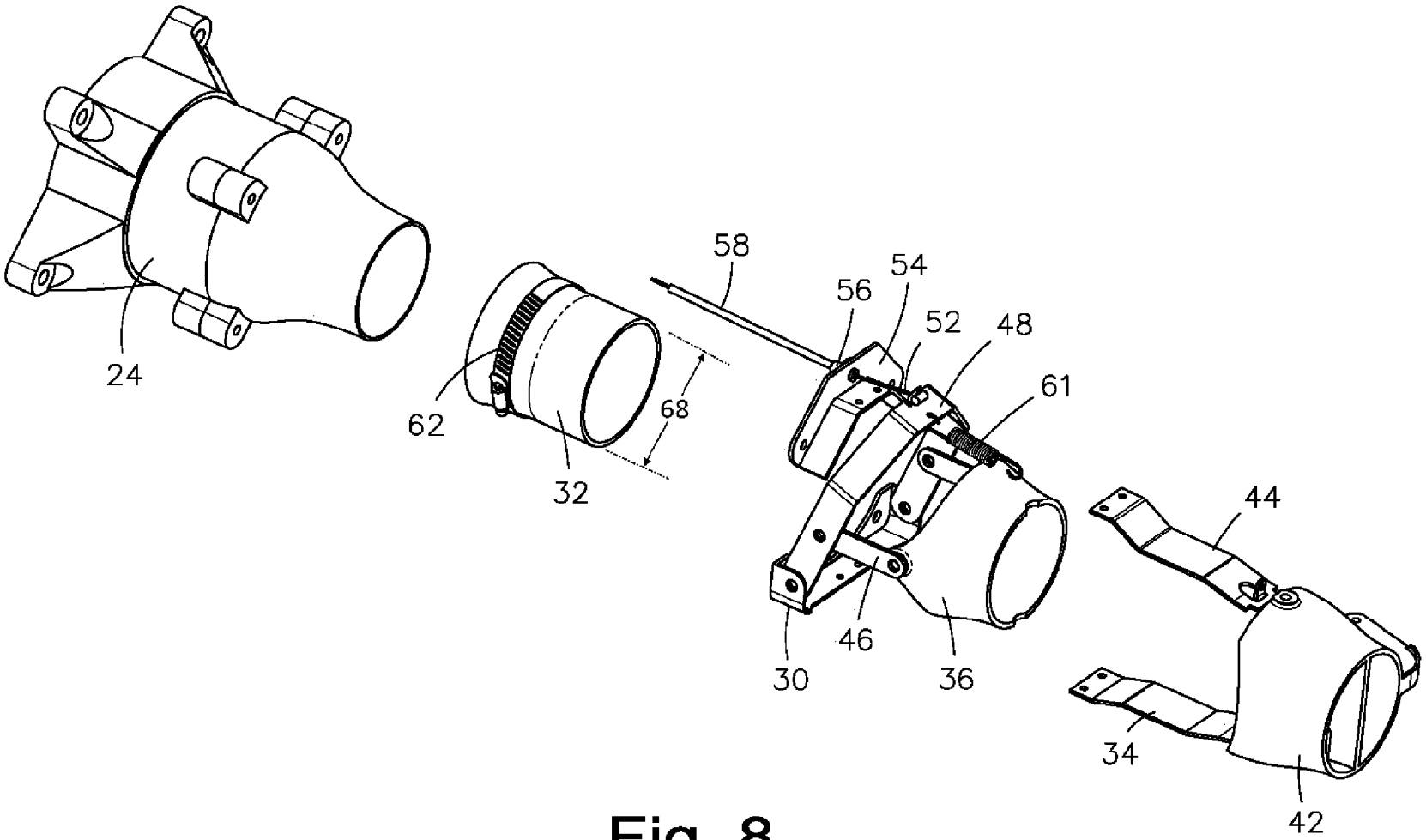
FIG. 8 is an exploded perspective view of a variation of the device showing relative position of constituent parts.

In the example in the drawings best seen in FIGS. 3 and 8, a forward end of the ring 32 is affixed to the aft end of the housing by means of a band 62. For some applications the band 62 may take the form of a hose clamp (also sometimes referred to as a radiator clamp, band clamp, screw clamp, worm gear clamp, wire clamp, ear clamp and others). A ring clamp or other available bracket, fixture or clamp to attach the ring 32 to the aft end of the housing 24 and retain the ability to remove and replace the ring 32 may also be equally effective and remain within the scope of the invention.

In at least one version of the device it is desirable to have the ability to install and remove the ring 32 from the housing 24 with an externally mechanical means. To this end a clamping means of a ring with an adjustable circumference to loosen and tighten the ring 32 over the aft end of the housing 24 is advantageous.

It is important that the connection means of the fore end of the ring 32 is firmly attached the aft end of the housing 24 so that the ring 32 will not become detached from the housing 24 during use. There is significant high water flow and pressure experienced inside the pump that could affect the connection. It would be problematic if there was an unintended separation between the ring 32 and housing 24 during normal use.

Where the front edge of the ring 32 is affixed over the trailing edge of the housing 24, the ring 32 extends further aft than the aft end of the housing 24. The aft portion of the ring 32 should be allowed to annularly compress without undue restriction from the rigidity of the housing 24 material. In other words, the rear-most segment of the ring 32 should not contain elements of the housing 24 that would unnecessarily restrict the ability of the ring 32 to compress and therefore change the inside diameter of the aft end of the ring 32.

In at least one variety of the device the forward end of the ring 32 has a larger inside diameter than the aft end of the ring. This may be so that the forward inside diameter of the ring 32 can mate and attach over the aft outside diameter of the housing 24 and yet the interior diameter of the aft end of the ring 32 is about the same dimension as the inside diameter of the aft end of the housing 24. This reduction characteristic can manifest in either a stepped cylinder shape or conical. In another example the ring 32 is funnel shaped with a larger forward diameter (where the ring 32 connects to the housing 24) than the rear diameter (where the water exits the ring 32.)

In another variety of the device the ring 32 has a constant inside diameter from the fore edge to the aft edge. In this sense the ring 32 has a cylindrical shape. This may have the advantage of manufacturing expediency and therefore cost. Other advantages may also be observed from a pure cylindrical ring 32.

The ring 32 in an important version of the device is made of a deformable and durable material. For example, a rubber, plastic, silicone or other material with similar characteristics may be used. The material may be constructed of a combination of materials and may be with or without a reinforcing membrane or fabric integral to material. The material should be capable of annular compression to reduce the interior diameter and then readily spring back to the original shape and diameter.

The collar 36 is dimensioned on a front end to fit over and around the rear end of the ring 32. The interior diameter of the collar tapers from being wider on the front end to being narrower towards the rear end. As the collar 36 is forced over the ring 32 the aft end of the ring 32 compresses annularly to decrease the diameter 68 at the aft end of the ring 32. Similarly, when the collar 36 is engaged into the aft end of the ring 32 and then the collar 36 is pulled away from the ring 32 then the ring 32 is allowed to re-expand to its natural diameter 68 dimension.

Figure 5:
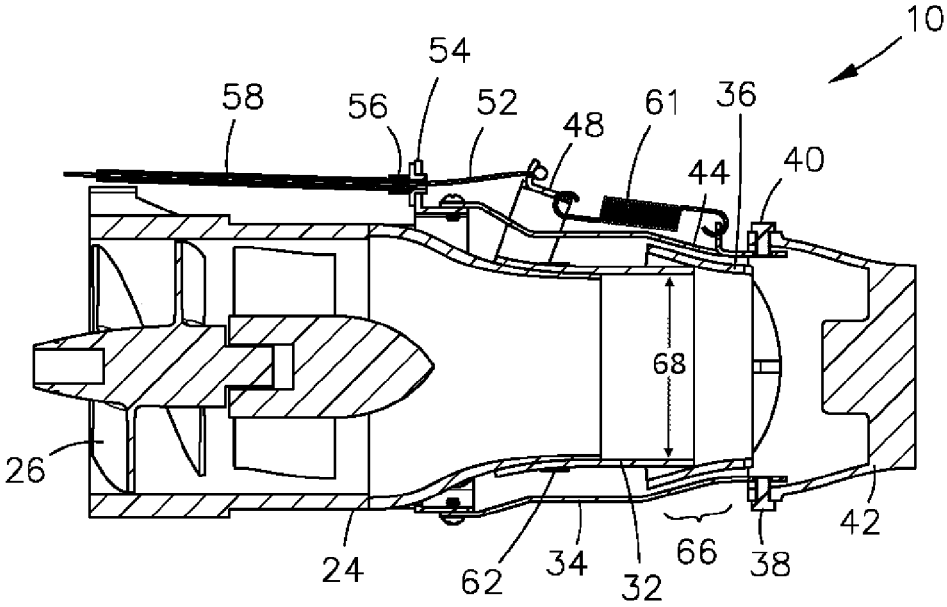
FIG. 5 is an elevation cross section view from a left side of a device in a first mode.
Figure 7:
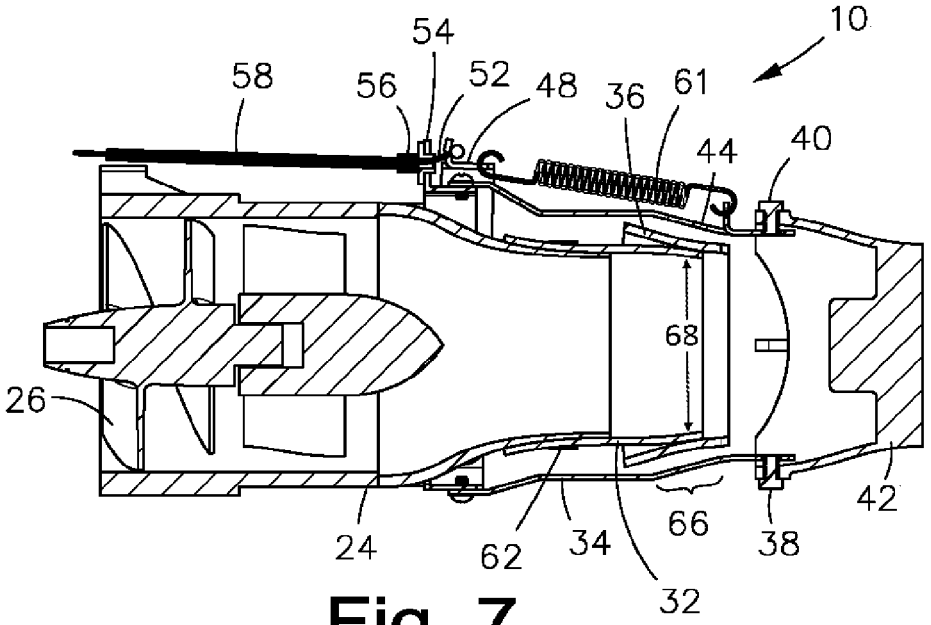
FIG. 7 is an elevation cross section view from a left side of a device in a second mode.

FIGS. 5 and 7 show the transition from the larger diameter 68 in FIG. 5 to the constricted diameter 68 in FIG. 7. Relatively small changes in the diameter 68 can have significant effects on the pressure and velocity of the water pumped through the system. When the rigid collar 36 is withdrawn in the aft position in FIG. 5 the collar 36 does not deform (or minimally deforms) the aft end of the ring 32. The water stream passing through the housing 24 then ring 32 also passes through the collar 36 and nozzle 42. The ring 32 is essentially the venturi.

FIG. 7 shows the collar 36 pressed over the aft end of the ring 32 to annularly compress the aft end of the ring 32 effectively reducing the diameter 68 of the ring 32 at the aft end in the compression zone 66. In other words the aft end of the ring 32 is constricted in FIG. 7 contrasted to being more dilated as shown in FIG. 5.

Figure 4:
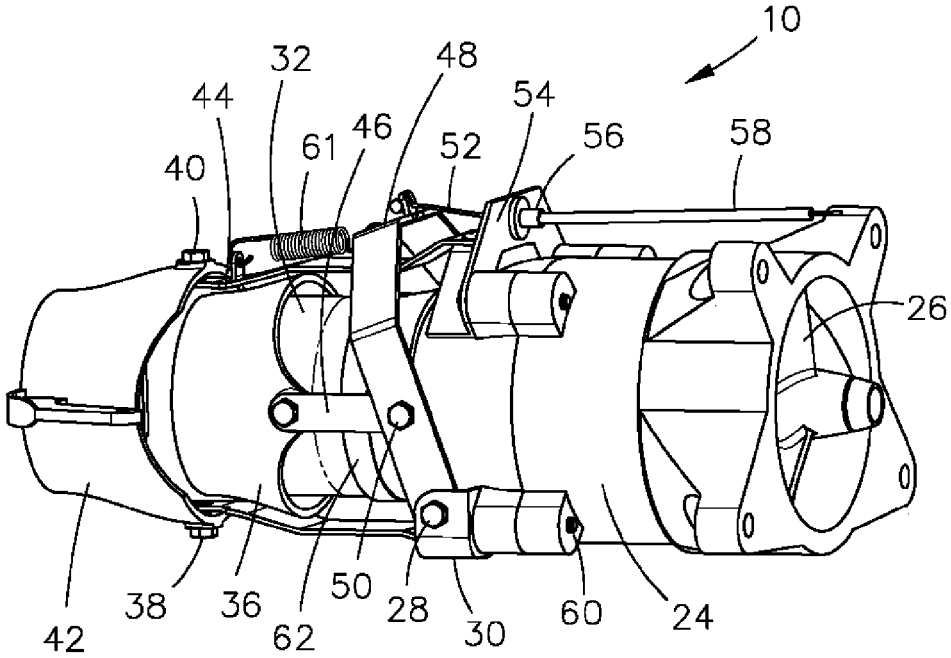
FIG. 4 is a representation of a perspective view of a version of the device from a right side in a first mode.

FIG. 4 shows the device in the same dilated mode as in FIG. 5. The diameter 68 is at the wider position. The lever 48 is in the aft-most position. The lever 48 articulates about hinge 28. The arm 46 connects the collar 36 to the lever 48. When the lever 48 is in the aft position then the collar 36 is pushed aft and tends to disengage the ring 32 effectively dilating the ring 32. A spring 61 optionally biases the lever 48 in an aft position where the ring 32 is dilated.

Figure 6:
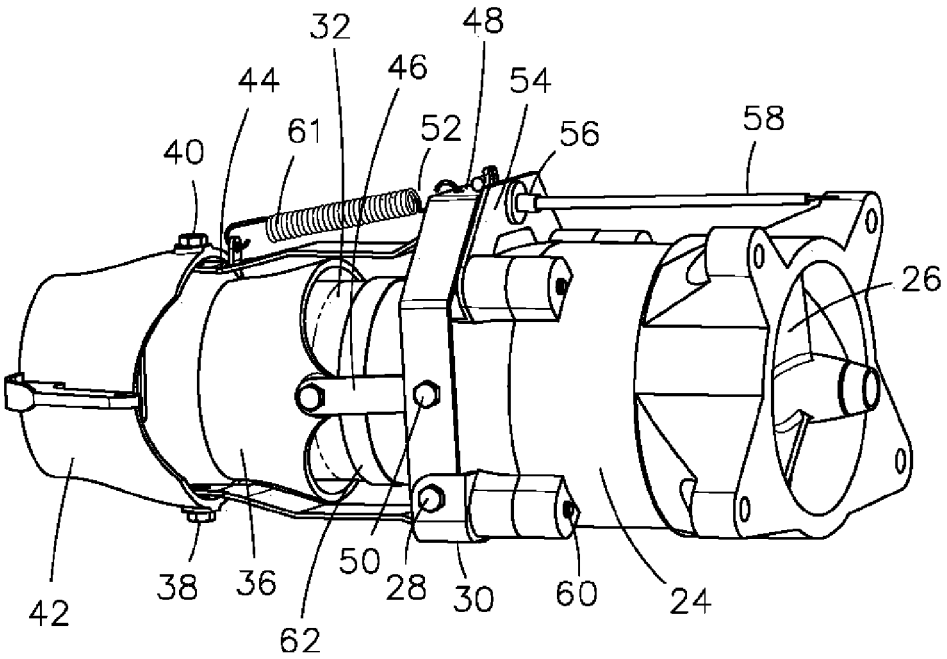
FIG. 6 is a perspective view of a version of the device from a right side in a second mode.

FIG. 6 shows the device in the same constricted mode as in FIG. 7. The lever 48 is pushed in the forward position about hinge 28 that in turn pulls the collar 36 forward with arm 46. This results in a compression or constriction of the ring 32 in the compression zone 66.

The hinge 50 allows the arm 46 to roughly remain parallel to the direction of thrust. This helps keep the collar 36 coaxial with the ring 32. The compression zone 66 should preferably be uniformly applied to the ring 32 so that the aft end of the ring 32 remains substantially circular whether in compression or dilation mode.

The cable 52 controls the movement of the lever 48. On one end of the cable 52 not shown it terminates in a user control. For example the end of the cable 52 opposite the lever 48 may be positioned on or near the handlebars of a personal watercraft (PWC). On many PWCs the throttle is on the right hand grip. It may be convenient to place a lever, handle or other similar type of control on or near the left hand grip to force the cable 52 axially through the sheath 58.

In other applications, such as an outboard boat with a jet outdrive or an inboard-outboard with a jet outdrive, the controls may be more conveniently located on the helm near the other throttle and shift controls. The helm controls could be a lever or other similar means to affirmatively and selectively force the collar 36 towards or away from the ring 32 to affect the diameter 68 of the aft end of the ring 32, effectively changing the diameter of that venturi.

The cable 52 slides within a sheath 58. The cable 52 is generally coaxial to the sheath 58. Generally, the sheath 58 is fixed at both ends and the cable 52 slides within the sheath 58 to transfer motion on one end to the other. In this case motion is input by the operator at the helm to the lever 48.

The cable within sheath method of controlling the engagement of the collar 36 onto the aft end of the ring 32 is not the only contemplated method. For example, hydraulics, rods, bare cables and many other means commonly available to transfer a physical input at one point to another may be effectively employed. There may alternatively be electronic actuators with or without servos in a fly by wire system without a physical connection between the collar 36 and the controls.

In another adaptation a vacuum driven (or positive pressure driven) system can power assist an operator's controls to force the collar 36 onto the ring 32 to alter the diameter 68.

The aft end of the sheath 58 is connected to a bracket 54 to hold the sheath solidly in place on the housing 24. The controls at the helm can then slide the cable 52 axially inside the sheath 58 to push and pull the lever 48 to ultimately vary the diameter 68 of the ring 32 in the compression zone 66.

An adjuster 56 is optionally present to make fine tune adjustments to where the sheath 58 connects relative to the bracket 54. By moving the adjuster 56 closer or further from the bracket 54 the tension on the cable 52 can be adjusted. This may be necessary to improve the feel and performance of the helm control as there should be minimal slop or play in the controls while retaining the full effective range of the cable 52 to fully dilate and fully constrict the ring 32. The bracket 54 is affixed relative to the housing 24.

The band 62 secures the forward end of the collar 36 onto the aft end of the housing 24. The band 62 mechanically seals the collar 36 onto the housing. The band 62 is loosen-able so that the collar 36 can be removed and replaced if needed. Generally, the band 62 is secured forward of the compression zone 66. The band 62 can be any device that secures the ring 32 onto the housing 24. The band 62 could be a band clamp, straps or other commonly available fastener.

A plurality of fasteners 60 are optionally provided around the periphery of the housing 24 that permit separation of the housing 24 for access into the interior for maintenance or replacement of the impeller 26 or other internal components.

The brackets 34 and 44 provide a mounting structure to hold the nozzle 42 onto the housing 24. The brackets 34 and 44 essentially extend over the collar 36 so that the articulation of the collar 36 forward and aft is not affected. This is necessary because the nozzle 42 must be free to move left and right about hinge 38 and 40 to steer the craft left and right during normal operation of the craft.

In practical use the operator of the watercraft fully dilates the ring 32 by disengaging the collar 36 from the aft end of the ring 32 so that the diameter 68 is at its maximum when beginning from a stop. This provides the maximum water output through the pump thus results in rapid acceleration. As the watercraft gains speed and while remaining under power the operator constricts the diameter 68 by engaging the collar 36 over the aft end of the ring 32. When the diameter 68 is restricted the pressure of water will increase and thus the velocity of the water exiting the rear of the vehicle increases thereby increasing the maximum top end speed of the craft.

A version of the invention can be fairly described as a marine jet pump comprising of a housing, a ring and a collar. The housing contains an impeller that is substantially coaxial to the collar and the ring. The impeller imparts a force onto the water to drive the vehicle. The ring at a forward end is affixed to an aft end of the housing around the water exit of the housing. At an aft end of the ring is an inside diameter that is commonly referred to as the venturi diameter. The inside diameter is naturally biased to a dilated state by the flexible nature of the material from which it is made. The aft end of the ring is annularly compressible to reduce the inside diameter to a constricted state when compressed by the collar. The collar at a forward end is larger than an aft end. The aft end of the ring is dimensioned to engage into the forward end of the collar. In a constricted mode the collar is selectively operated to engage around the aft end of the ring to a predetermined distance to annularly compress the inside diameter of the aft end of the ring into the constricted state. This effectively results in a constricted venturi. When in a dilated mode the collar is selectively operated to disengage the collar from the aft end of the ring to a predetermined distance so that the aft end of the ring is in the dilated state. In other words, the collar does not deform the ring in the dilated mode.

Other versions of the invention include that the collar is coaxially moved relative to the ring by a mechanical linkage between a helm control and the collar. This can be done by a lever or other similar means near the steering controls. The mechanical linkage can optionally include a power assist that is driven in part by a motor. This can be actuated by a power take off, vacuum or controls in the stream of water. In at least one version the ring is comprised of rubber and the collar is comprised of a rigid material selected from a metal, a plastic, a fiberglass, a carbon fiber or other substantially rigid material. For maintenance and repair, the ring is optionally mechanically connected and removable from the housing by means of a clamp, ring or other similar available means.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A marine jet pump comprising of a housing, a ring and a collar;

the housing contains an impeller that is substantially coaxial to the collar and the ring;

the ring at a forward end is affixed to an aft end of the housing;

at an aft end of the ring is an inside diameter;

the inside diameter is naturally biased to a dilated state;

the aft end of the ring is annularly compressible to reduce the inside diameter to a constricted state;

the collar at a forward end is larger than an aft end;

the aft end of the ring is dimensioned to engage into the forward end of the collar;

in a constricted mode the collar is selectively operated to engage around the aft end of the ring to a predetermined distance to annularly compress the inside diameter of the aft end of the ring into the constricted state;

in a dilated mode the collar is selectively operated to disengage the collar from the aft end of the ring to a predetermined distance so that the aft end of the ring is in the dilated state.

2. A marine jet pump as in claim 1 further characterized in that the collar is coaxially moved relative to the ring by a mechanical linkage between a helm control and the collar.

3. A marine jet pump as in claim 2 further characterized in that the mechanical linkage includes a power assist that is driven in part by a motor.

4. A marine jet pump as in claim 2 further characterized in that the ring is comprised of rubber and the collar is comprised of a rigid material selected from a metal, a plastic, a fiberglass or a carbon fiber.

5. A marine jet pump as in claim 2 further characterized in that the ring is mechanically connected and removable from the housing.

* * * * *